US008256643B2

(12) United States Patent
Uytterhaeghe et al.

(10) Patent No.: US 8,256,643 B2
(45) Date of Patent: Sep. 4, 2012

(54) CLOSURE WITH ELASTIC HINGE

(75) Inventors: Luc Uytterhaeghe, Varreddes (FR); Frédéric Berthelin, Meaux (FR); Chi Hung Vo, Meaux (FR); Serge Lebalc'h, Penchard (FR)

(73) Assignee: Seaquist General Plastics, Poincy (FR)

( * ) Notice: Subject to any disclaimer, the term of this patent is extended or adjusted under 35 U.S.C. 154(b) by 912 days.

(21) Appl. No.: 11/664,720

(22) PCT Filed: Sep. 12, 2005

(86) PCT No.: PCT/EP2005/009781

§ 371 (c)(1),
(2), (4) Date: Jan. 30, 2008

(87) PCT Pub. No.: WO2006/037431

PCT Pub. Date: Apr. 13, 2006

(65) Prior Publication Data

US 2008/0203106 A1 Aug. 28, 2008

(30) Foreign Application Priority Data

Oct. 5, 2004 (FR) ..... 04 10503

(51) Int. Cl.
*B65D 51/18* (2006.01)

(52) U.S. Cl. ..... 220/836; 220/254.1; 220/254.5

(58) Field of Classification Search ..... 220/836, 220/254.5, 254.3, 254.1, 326, 324, 827, 845, 220/810, 837, 838

See application file for complete search history.

(56) References Cited

U.S. PATENT DOCUMENTS

| | | | | | |
|---|---|---|---|---|---|
| 3,629,901 | A | | 12/1971 | Wolf et al. | |
| 3,933,271 | A | * | 1/1976 | McGhie | 220/838 |
| 4,158,902 | A | * | 6/1979 | Chernack et al. | 16/227 |
| 4,346,810 | A | * | 8/1982 | Kneissl | 215/237 |
| 4,487,324 | A | * | 12/1984 | Ostrowsky | 215/253 |
| 4,887,747 | A | * | 12/1989 | Ostrowsky et al. | 222/556 |
| 5,257,708 | A | * | 11/1993 | Dubach | 220/827 |
| 5,358,151 | A | * | 10/1994 | Strasenburgh | 222/420 |
| 5,423,442 | A | * | 6/1995 | Nozawa et al. | 215/235 |
| 5,435,456 | A | | 7/1995 | Dubach | |
| 5,460,282 | A | * | 10/1995 | Giblin et al. | 215/260 |
| 5,735,418 | A | * | 4/1998 | Erb et al. | 215/237 |
| 5,806,678 | A | * | 9/1998 | Hakansson | 206/438 |
| 5,817,067 | A | * | 10/1998 | Tsukada | 604/256 |

(Continued)

FOREIGN PATENT DOCUMENTS

DE 92 15 148 U1 3/1994

(Continued)

*Primary Examiner* — J. Gregory Pickett
*Assistant Examiner* — Ernesto Grano
(74) *Attorney, Agent, or Firm* — Wood, Phillips, Katz, Clark & Mortimer

(57) ABSTRACT

An articulated structure to connect a cover to a support, which may be installed on a container or is formed from a single piece with an opening section of the container, comprising an articulated joint to guide the cover between a closed position and an open position with a pivot point situated on the outer side of the cover and/or the support, and an elastomer spring part, which grips the outer side of the cover as well as the support and is prestressed at least in the closed position of the cover under tension, characterized in that a force application point of the elastomer spring part to the cover and/or to the support at least in the closed position of the cover is displaced to the outside beyond the pivot point of the articulated joint.

11 Claims, 13 Drawing Sheets

U.S. PATENT DOCUMENTS 5,913,435 A * 6/1999 Fuchs ..... 215/237
D431,322 S * 9/2000 Lemoine ..... D28/73
7,044,317 B2 * 5/2006 Smith et al. ..... 215/235
2004/0016714 A1 1/2004 Wood et al.

FOREIGN PATENT DOCUMENTS

GB 1 056 999 A 12/2001

* cited by examiner

CLOSURE WITH ELASTIC HINGE

This application is a National Stage filing of International Application Serial No. PCT/EP2005/009781 filed Sep. 12, 2005 which claims priority of French Patent Application Serial No. 0410503 filed Oct. 5, 2004, the disclosures of which are incorporated herein by reference.

TECHNICAL FIELD

The invention relates to an articulated structure to connect a cover to a support, that may be installed on a container, particularly in a plastic material, or that may be formed of a single piece with an opening section of the container.

BACKGROUND OF THE INVENTION

An articulated structure of this type is, for example, presented in document US 2004 0016714 A1, for which the movement to open a cover is executed by a film hinge. Furthermore, the opening movement is supported by a prestressed elastomeric spring part situated adjacent to the outer side of the film hinge. The disadvantage of the known articulated structure resides in the fact that only low elastomeric spring part forces may be available for an autonomous opening of the cover. More particularly, in case of high resistance to an opening movement, this elastomeric spring part opening force does not suffice.

BRIEF SUMMARY OF THE INVENTION

The object of the invention is to eliminate the disadvantages of the prior art, and more particularly to improve an articulated structure to connect a cover to a support in such a way that significant forces are made available for the opening movement of the cover.

This goal is resolved by the articulated structure to connect a cover to a support according to the invention, that may be installed on a container or may be formed from a single piece with an opening section of the container, comprising an articulated joint to guide the cover between a closed position and an open position with an pivot point situated on the outer side of the cover and/or the support, and an elastomeric spring part, that grips the outer side of the cover as well as the support and is prestressed at least in the closed position of the cover under tension, which is distinguished in that a force application point of the elastomeric spring part to the cover and/or to the support at least in a closed position of the cover is displaced to the outside beyond the pivot point of the articulated joint.

According to the invention, the elastomeric spring part is prestressed at least in the closed position of the cover under tension, at least one elastomeric spring part force application point to the cover and/or to the support at least in the closed position of the cover is displaced beyond the articulated joint with relation to the cover and/or to the support by exceeding the pivot point. The articulated structure according to the invention provides a structural separation of the articulated joint from the elastomeric spring part, in such a way that it is possible to generate significant driver torques to open the cover. Thanks to the displacement of a force application point from the cover and/or the support to the outside, beyond the pivot point, lifting ratios for opening the cover between the pivot point and the prestressed elastomeric spring part under tension are optimized.

In a preferred embodiment of the invention, the articulated structure may be formed by a pair of articulated joints with parallel pivot points, preferably aligned, that are associated to one, two or more prestressed elastomeric spring parts under tension at least in the closed position of the cover. Furthermore, the articulated structure according to the invention may be formed by a pair of elastomeric spring parts that are associated with a more particularly reinforced articulated joint. To obtain optimal opening force input, the reinforced articulated joint may be disposed in the middle between two elastomeric spring parts.

Thanks to the measurement according to the invention of the displacement of an elastomeric spring part force application point to the cover and/or to the support beyond the pivot point, assembly of the elastomeric spring part with the stored initial stress is obtained, at least in the closed position of the cover situated in an interval that is larger than the pivot point with relation to the cover and/or the support, which pivot point is preferably situated beyond the outer side of the cover and/or the support.

In a preferred embodiment of the invention, displacement of the elastomeric part force application point, more particularly the elastomeric part force application point at the level of the cover and the support, is done in such a way that at least one projection or a part in rigid projection, preferably two parts in rigid projection, are provided to fix the elastomeric spring part to the respective cover and/or respective support. A projecting part or two projecting parts may extend to the outside, more particularly above and/or below the pivot point, by exceeding the pivot point. Preferably, the two projecting parts are parallel to each other in the closed position of the cover.

In a preferred embodiment of the invention, the projecting part or projecting parts are made of one piece with the respective element, cover or support, more particularly, the parts are molded from a piece in a plastic material. The elastomeric spring part is fixed to the extremities of the projecting parts. Preferably, the projecting parts are moved away from the cover at an essentially equal distance in such a way that the elastomeric spring part is vertical with relation to a plane determined by the cover in its closed position.

In an embodiment of the invention, the elastomeric spring part force application points to the cover and to the support are displaced so far towards the outside in such a way that the elastomeric spring part assembly remains between the closed and open positions of the cover with relation to the latter still beyond the pivot point. In this way, optimal lift ratios are guaranteed for the entire opening movement to generate sufficient driver torque.

Preferably, the elastomeric spring part made structurally and separated from the articulated joint is made as an elastomeric band, whose force application points extend linearly and mainly parallel to the pivot point. For this purpose, the articulated joint may be made as a hinge with a pivot or swivel pin and a cylindrical housing. Preferably, the pivot is more particularly made from a single piece with the cover, in return the cylindrical housing and support are made from a single piece.

In an embodiment of the invention, the pivot point of the articulated joint is non-curved, but is more particularly straight. An aspect of the invention that is independent, but that may also be combined with the object of the invention mentioned above, relates to an articulated structure for which the articulated joint is provided to release the cover from the support. A device to release the hinge pivot from the cylindrical housing is designed to allow separation in each working position of the cover with relation to the support, more particularly exclusively in a predefined constructive position, more particularly a closed position of the cover, in which the significant tensile forces of the elastomeric spring part dominate, which force the hinge pivot against autonomous unclamping in the cylindrical housing. The release device is functionally associated with the prestressed elastomeric spring part under tension in such a way that the initial stress in tension stored in the elastomeric spring part is aligned with relation to the direction of unclamping. Preferably, the release device is made in such a way that the cylindrical housing for the hinge articulation is openly constructed from the side of the cover. In this way, the hinge pivot may be raised in a predefined working position by the open side of the cylindrical housing by overcoming the prestressed tension of the elastomeric spring part.

Another aspect of the invention that is independent from the objects of the invention mentioned above, but that may be combined with those objects, resides in the fact that the articulated structure must be provided with a pivot limitation device, which limits the opening movement of the cover. The elastomeric spring part is used to make an autonomous opening movement, in return the prestressed forces of the elastomeric spring part must be overcome to close the cover. When the cover is opened, the pivot limitation device guarantees that a predefined final position is obtained in a controlled manner.

Preferably, the pivot limitation device is formed by an abutment integrated into the articulated joint. This abutment may be formed by at least one stud fixed to the support, which is pointed to the inside of the cylindrical housing of the articulated joint and acts on the hinge pivot by limiting rotation. Preferably, the stud must therefore prevent the hinge pivot from unclamping from the cylindrical housing, at least in the open position of the cover.

In an embodiment, the pivot limitation device is made in such a way that a cover pivoting opening movement is limited to approximately 90° from the closed position of the cover.

Furthermore, the invention relates to a closing device for a container with a cover and an articulated structure according to the invention.

BRIEF DESCRIPTION OF THE DRAWINGS

Other advantages, characteristics and properties of the invention are clearly explained by the description of preferred embodiments of the invention by using the attached drawings, in which.

DETAILED DESCRIPTION OF THE INVENTION

Figure 1:
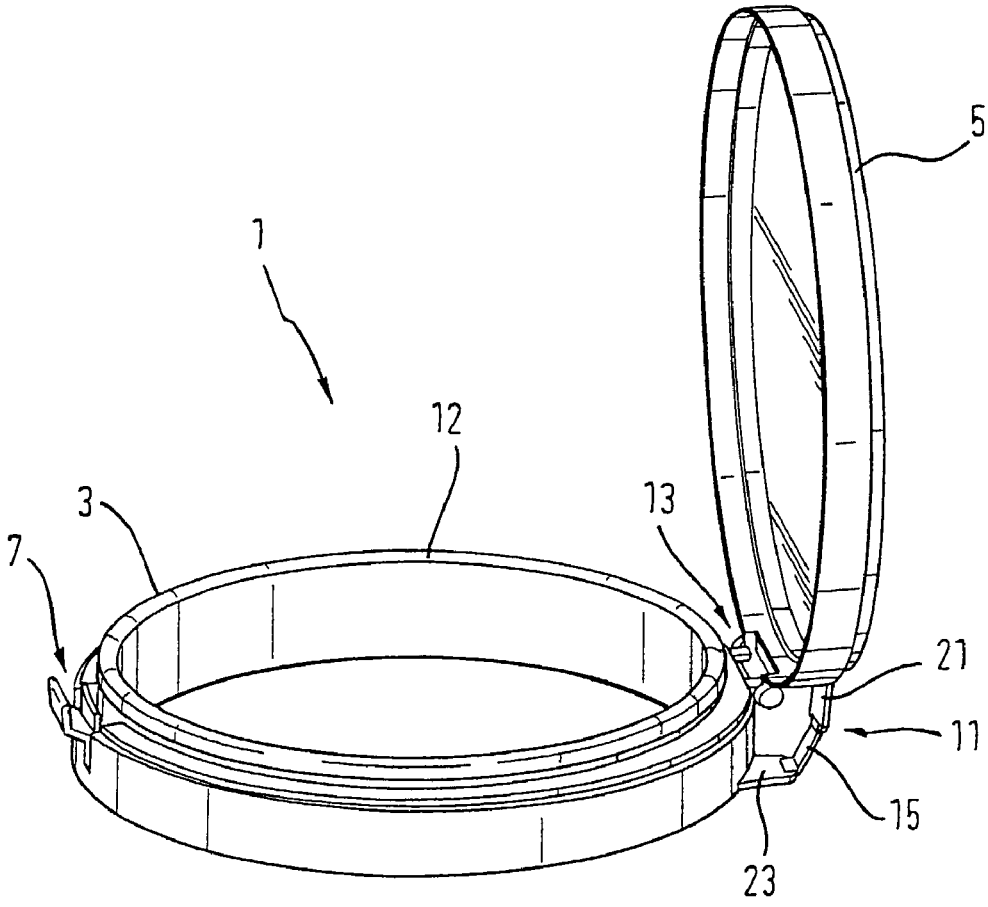
FIG. 1 illustrates a perspective view of a cover-support structure with an articulated structure according to the invention in a preferred embodiment.
Figure 2:
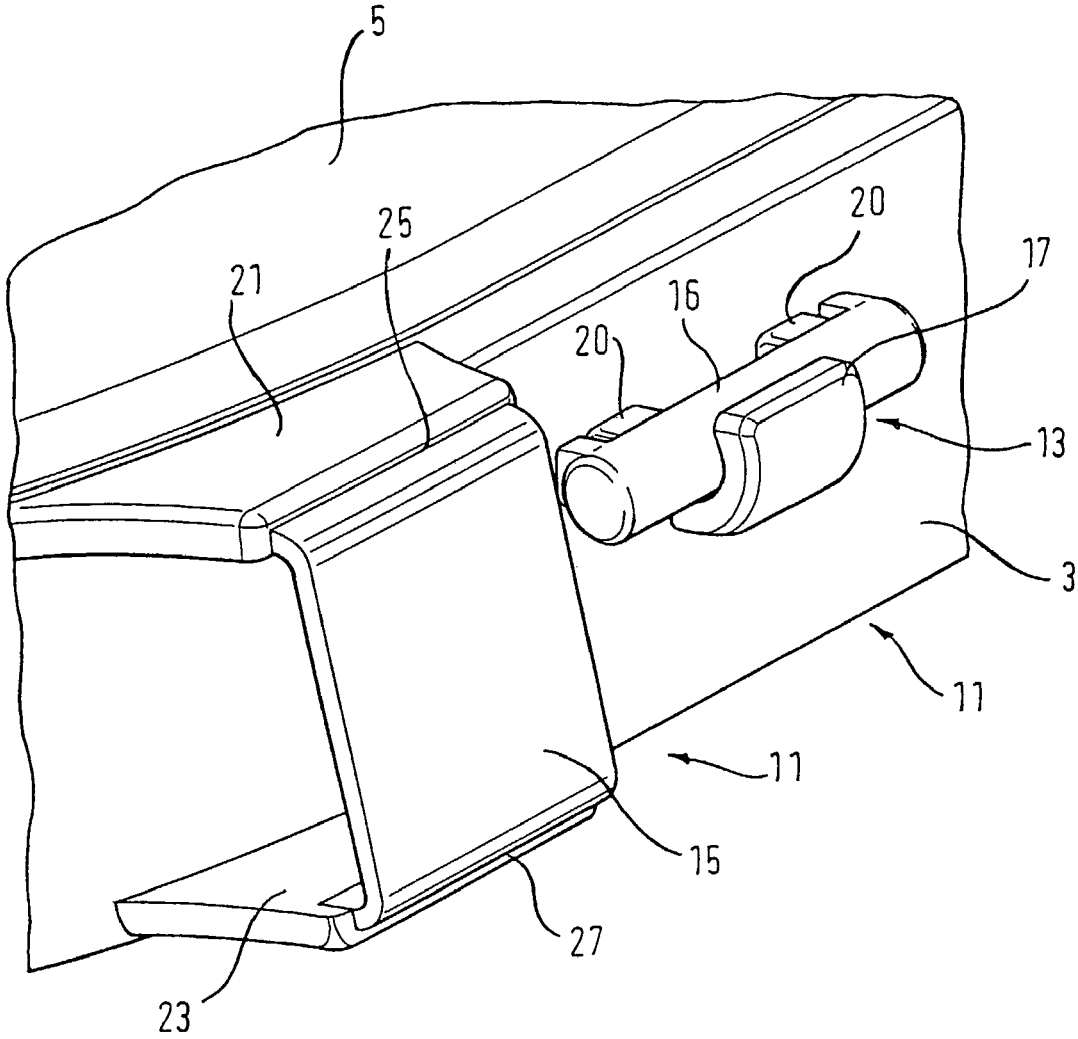
FIG. 2 illustrates a detailed perspective view of an articulated structure according to the invention, for which a cover is placed in a closed position with relation to a support.
Figure 3:
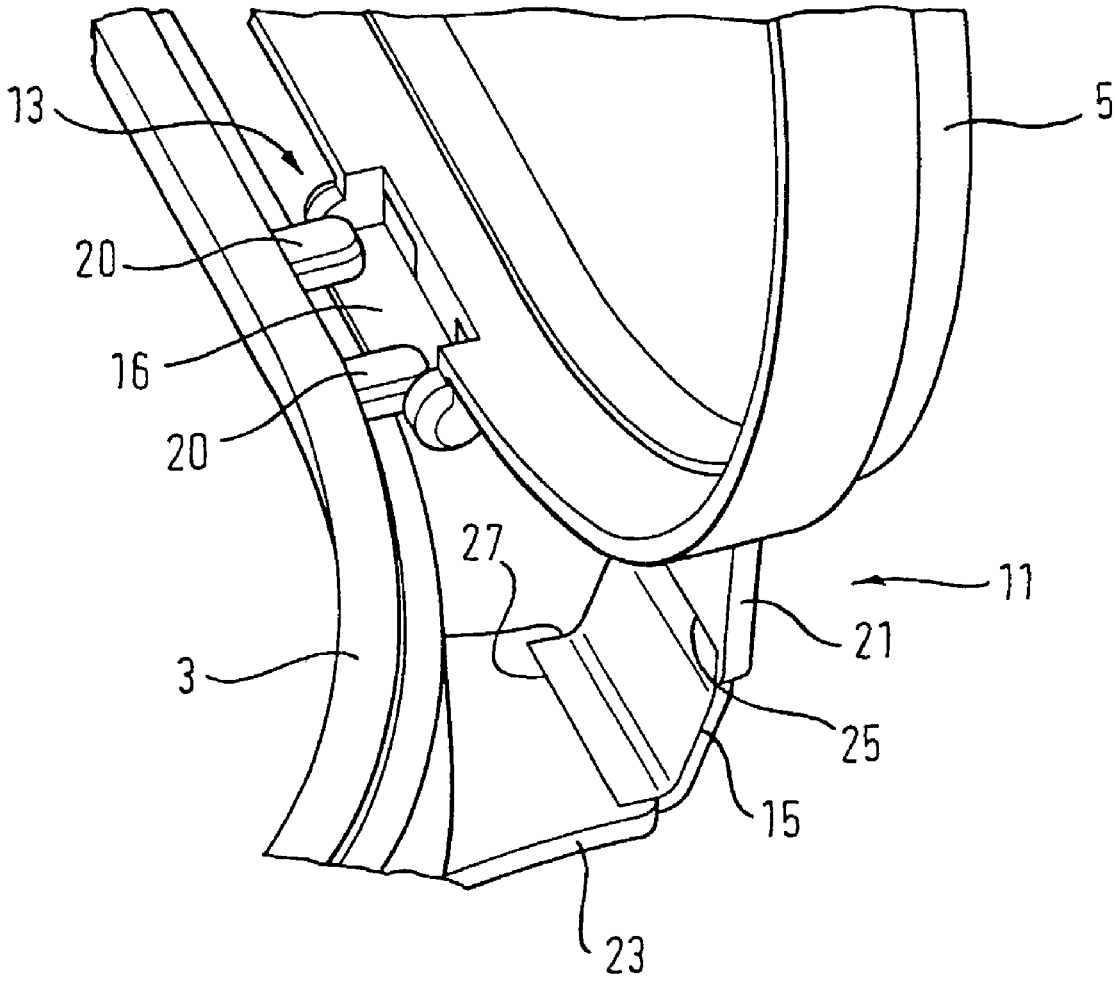
FIG. 3 illustrates a detailed perspective view of the articulated structure according to FIG. 2, in return the cover is placed in an open waiting position.

FIG. 1 illustrates a closing device 1 for a plastic container (not represented), which, as with most elements of closing device 1, may be molded from a plastic material. The closing device 1 comprises, as the main element, a support 3 mainly in the form of a ring, in ring form in the entirely encircled sense, a cover 5 that may flip or pivot with relation to support 3, a locking device 7, which maintains the cover in the closed position with relation to the support, and an articulated structure 11 according to the invention, which makes available an articulated connection between the cover 5 and the support 3 with a help system for driving the opening.

The support 3 may, as illustrated in FIG. 1, be designed as a separate element or as an element in a single piece with a container, not represented.

The support 3 comprises, from the inner side, a sealing lip 12 in flexible elastomer acting in conjunction with the cover 5 in its closed position. The locking device 7, which may be designed as a catch device, and which acts in conjunction in a locked manner with an element opposite from cover 5 in the closed position of the cover, is provided and is diametrically opposed to the articulated structure 11 according to the invention at the level of the outer side of closing device 1.

Subsequently, details of embodiment according to the invention of an articulated structure 11 are described with relation to FIGS. 1 to 6.

The articulated structure 11 comprises a hinge articulation 13 and an elastomer band 15 which is structurally separated from the hinge articulation 13.

The hinge articulation 13 comprises a hinge pivot 16, which is maintained in such a way as to be able to pivot in a cylindrical housing 17. The cylindrical housing 17 is open towards the top. A pair of studs extend below the cylindrical housing 17, from the edge of support 3 in the area of the cylindrical housing. Each stud 20 comprises a stop surface 19.

The hinge pivot 16 is essentially formed in half circle crosswise in the area of the cylindrical housing 17 when the cover 5 is assembled. The hinge articulation 13 defines a pivot point S, around which the cover 5 may be pivoted or flipped.

Figure 5:
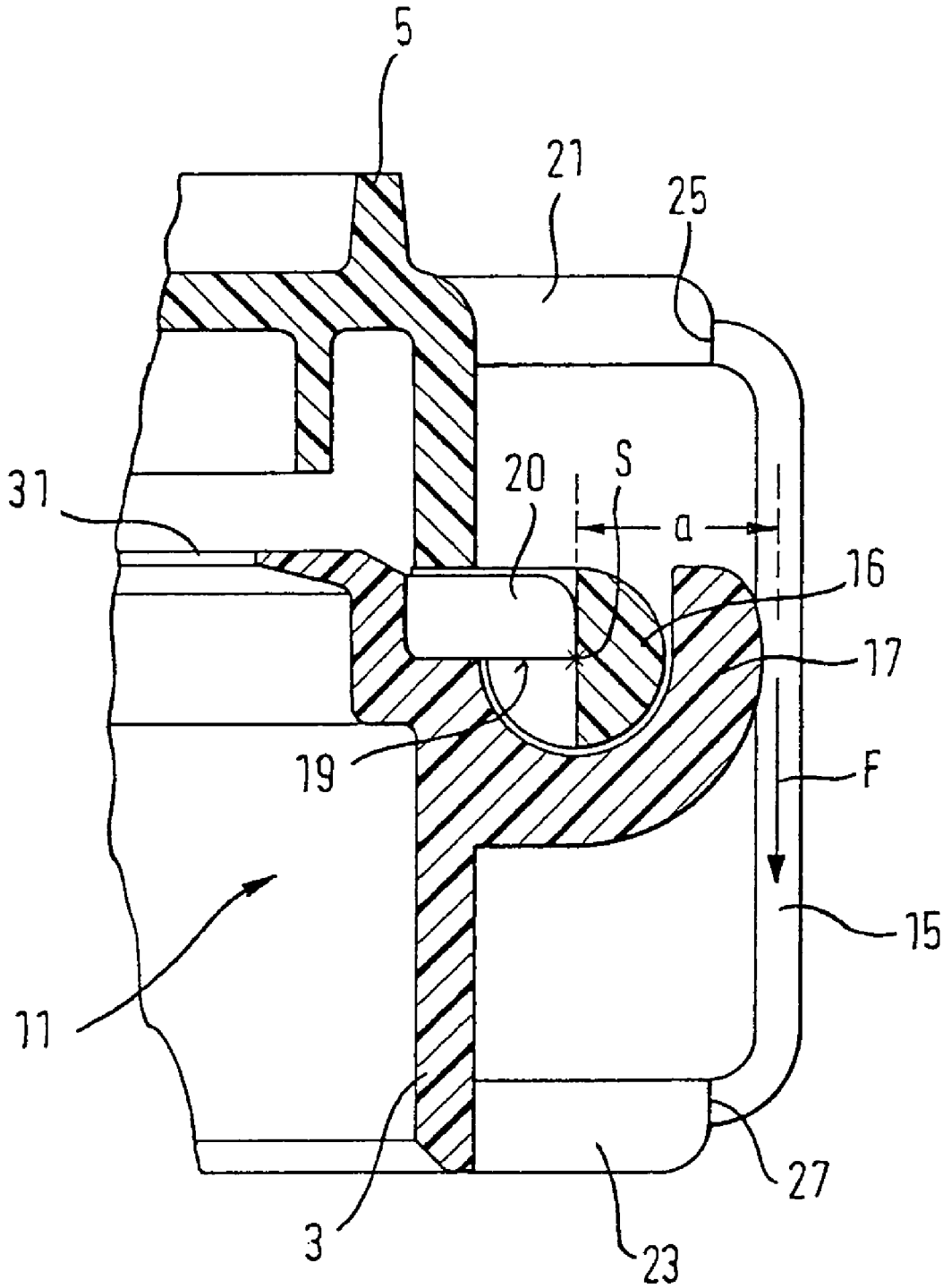
FIG. 5 illustrates a transversal section view of an articulated structure according to the invention, in return the cover is closed with relation to the support.

The elastomer band 15 is connected to the cover 5 and to the support 3 by projecting parts formed from a single piece with the respective element or offset sections 21, 23 which displace the force application points 25, 27 to the outside of the elastomer band 15 by moving them away from the support 3 and the cover 5 in such a way that the assembly of the elastomer band 15 is on the other side from the pivot point S with relation to cover 5 and to support 3, the interval of the elastomer band 15 to support 3 or cover 5 is larger than the interval of the pivot point S to support 3 or cover 5. As illustrated in FIG. 5, the offsetting of force application points 25, 27 from elastomer band 15 in the open position (FIG. 6) as well as in the closed position (FIG. 5) of cover 5 makes large leverage a available, at the level of which the abovementioned driving torque is generated by a prestressed force F of elastomer band 15.

Even during flipping of the cover 5, the elastomer band 15 still remains on the other side of the pivot point S with relation to support 3 in such a way that the leverage acts during the opening movements, which allows strong torque to be generated to open the cover 5.

Figure 6:
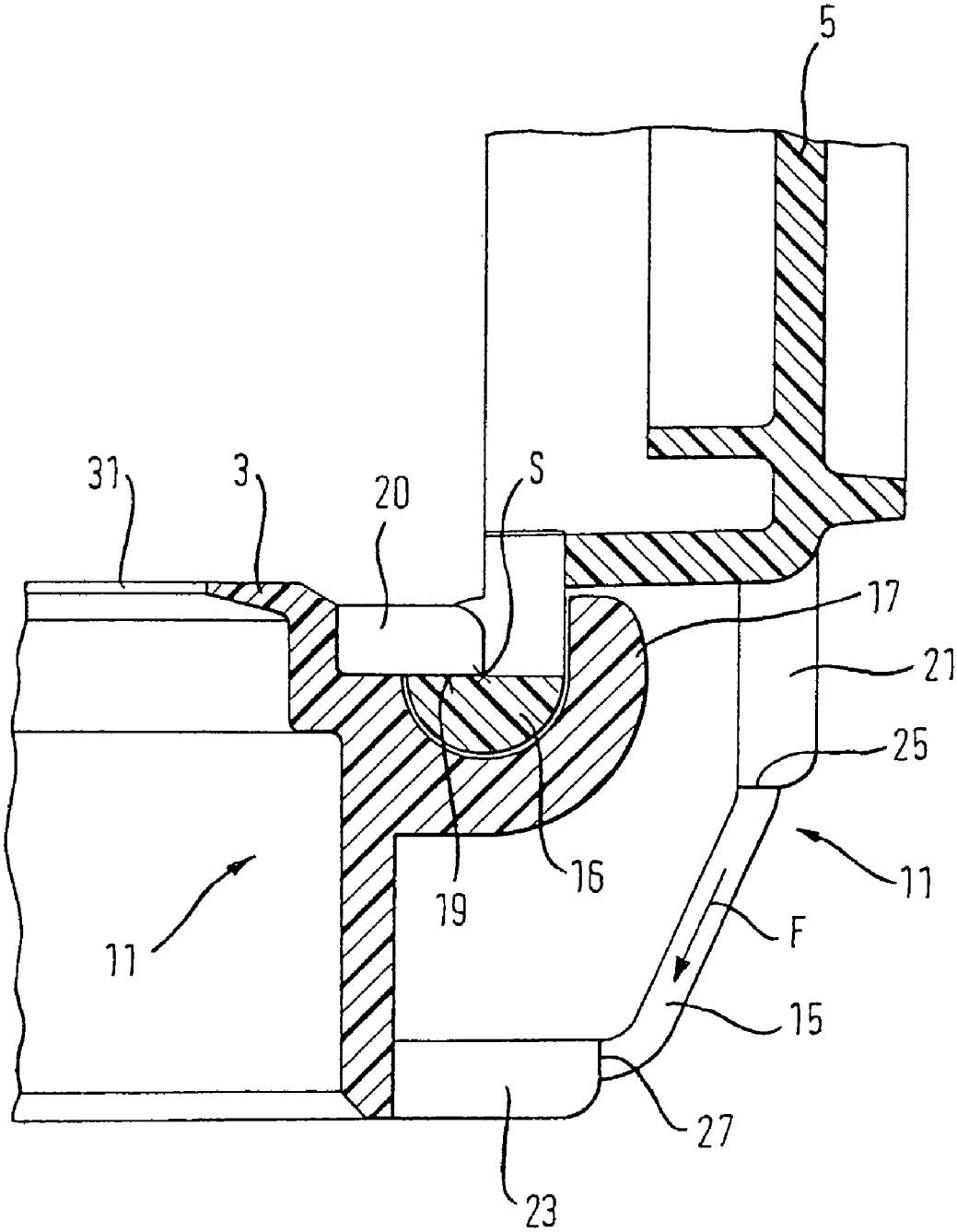
FIG. 6 illustrates a transversal section view of the articulated structure according to FIG. 5, in return the cover is in a vertical open position with relation to the support.

In an open position of cover 5 flipped 90° with relation to support 3, a flat side of the hinge pivot 16 hits against the stop surface 19 of stud 20 by which another flipping of cover 5 from the vertical position represented in FIG. 6 is prevented. Thanks to the prestressed force F still acting between the projecting parts 21, 23, the cover 5 is constrained and maintained in the open position represented in FIG. 6.

To maintain free access by cover 5 to an opening section 31 of support 3, the connection of cover 5 to support 3 may be resolved by the hinge articulation 13, while the hinge pivot 16 is retracted in the closed position illustrated in FIG. 5 from the cylindrical housing 17 against the prestressed force F by an additional extension of the elastomer band 15. The diameter of the hinge pivot 16 is therefore slightly less than the interval of the free extremity of the stud 20 to the opposite section of the cylindrical housing 17.

Figure 4:
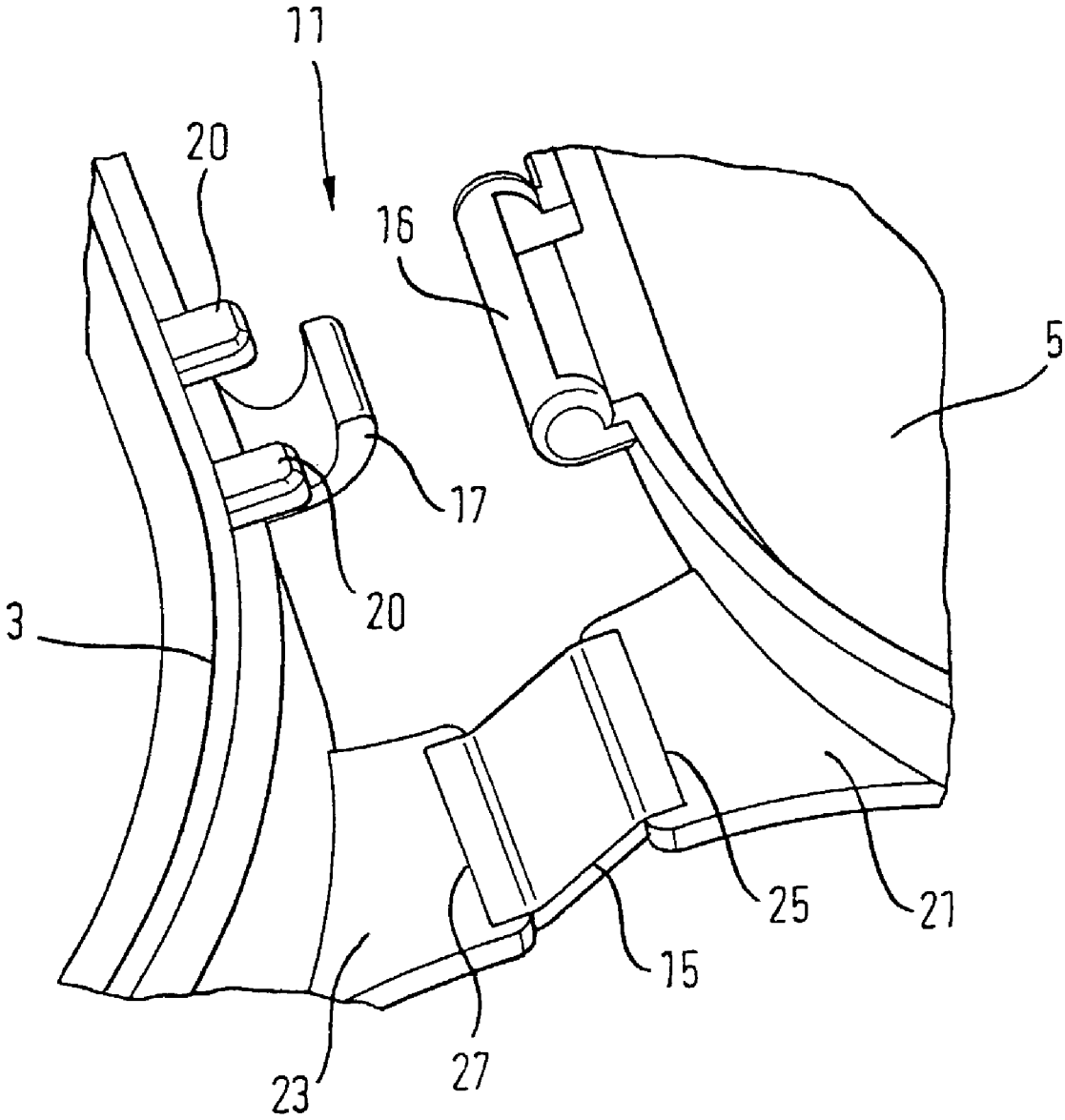
FIG. 4 illustrates a detailed perspective view of the articulated structure according to FIGS. 2 and 3, in return the connection of the cover with the support is separated by the articulated joint.

In the unclamped position illustrated in FIG. 4, the cover 5 is coupled only by the elastomer band 15 to the level of support 3, in return the elastomer band 15 is released.

Whole elements of the articulated structure 11 according to the invention as well as the support and cover may be made of polypropylene, more particularly molded polypropylene. A thermoplastic elastomer (TTE) is only utilized for elastomer band 15, which is embedded by molding at the level of the extremities of projecting parts 21, 23.

Figure 7:
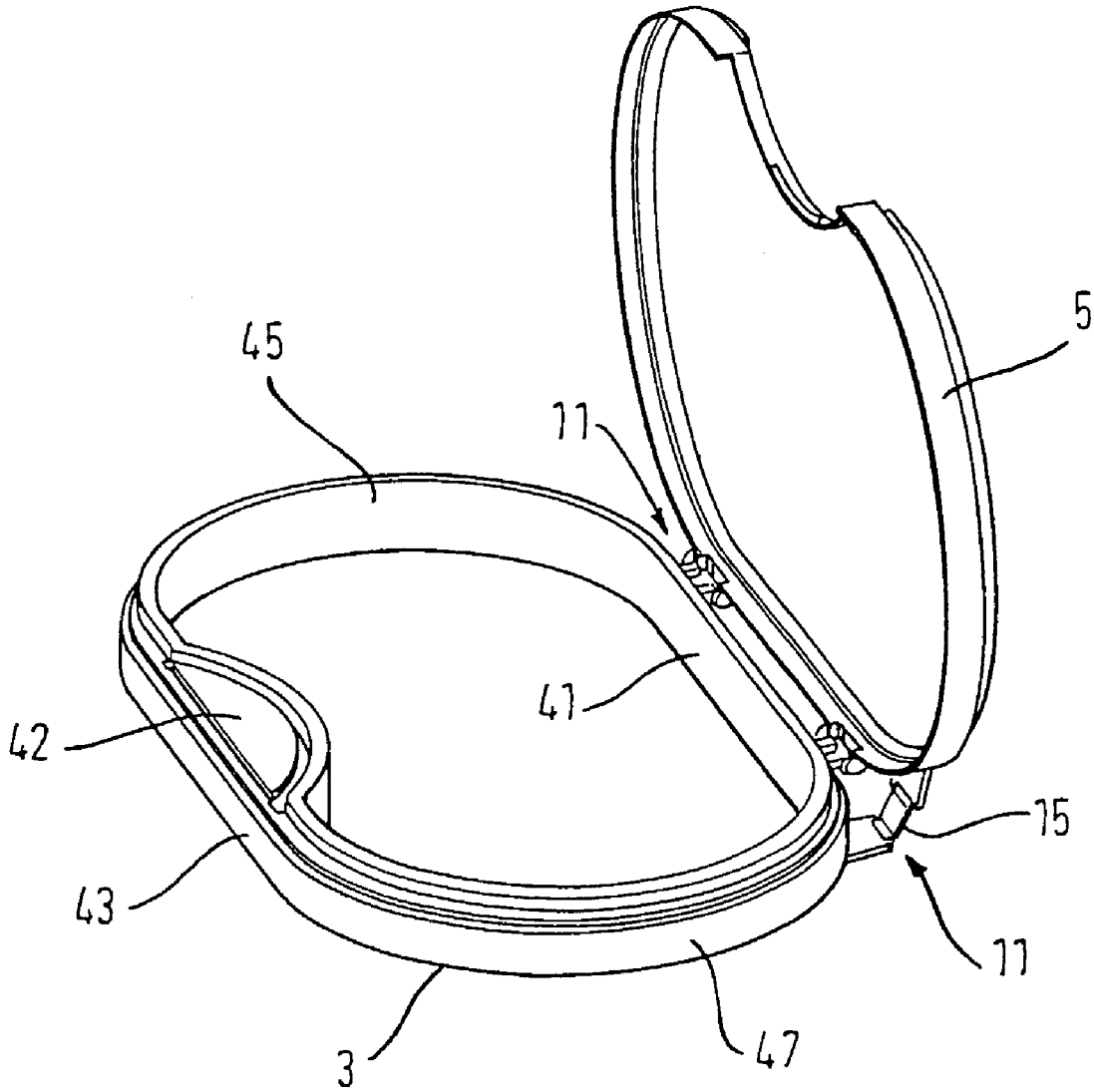
FIG. 7 illustrates a perspective view of another embodiment of a cover-support structure.

In FIG. 7, another embodiment of a cover-support structure with an articulated structure 11 according to the invention is represented, which is formed from a pair of hinge articulations 13 and a pair of elastomer bands 15 disposed in conformance with the embodiment according to FIGS. 2 to 6. The cover-support structure is differentiated from that according to FIG. 1 in that the elastomer band 15 is disposed mainly without being offset laterally with relation to the opposite hinge articulation 13.

The fundamental form of support 3 in the shape of a ring is characterized by two straight lateral sections 41, 43 that are parallel to each other, that are connected to each other by arc of circumference sections 45, 47. At the level of a straight lateral section 43, which is opposite to the section with the hinge articulation 13, an activation zone 42 is reinforced, which extends in a curved fashion to the inside. A recess in a form complementary to the activation zone 42 is provided in cover 5 in such a way that a user (not illustrated) may grip the reinforced zone of the support by the recess.

Figure 8:
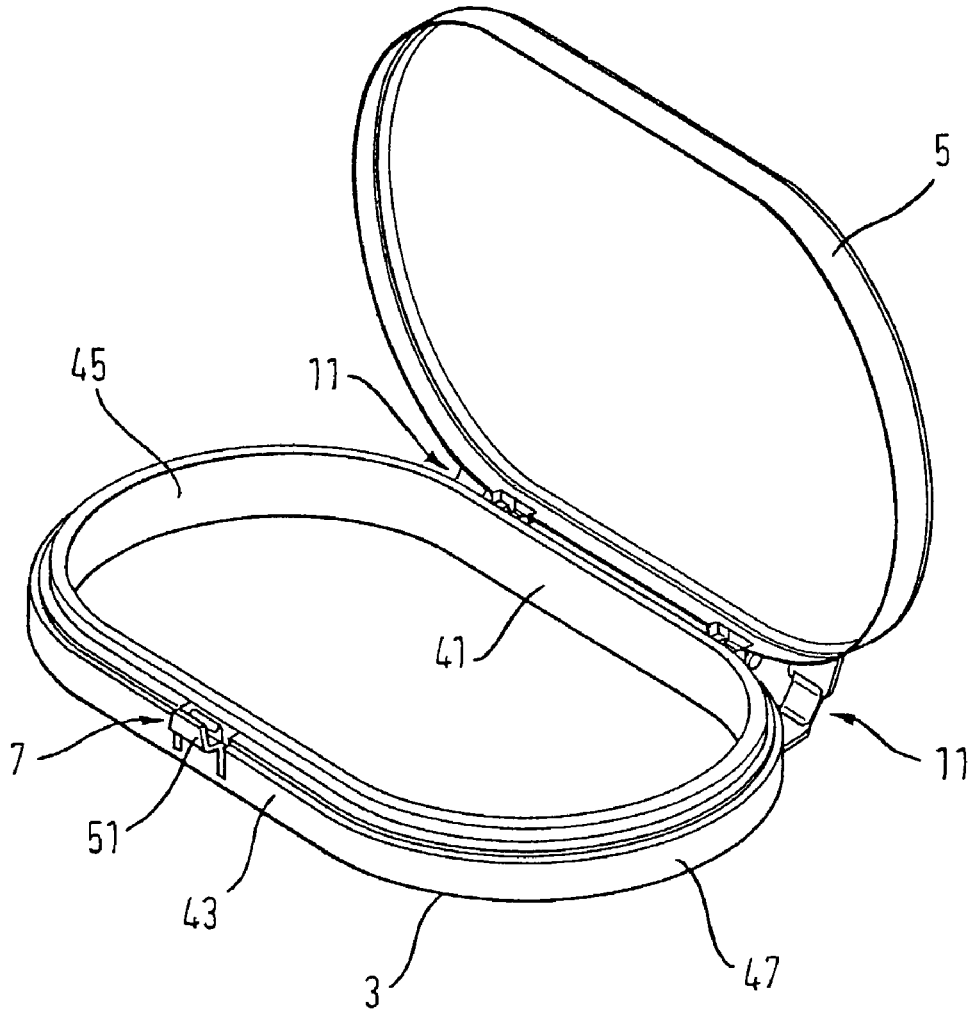
FIG. 8 illustrates another embodiment according to the invention of a cover-support structure.

The support-cover structure according to FIG. 8 is differentiated from that according to FIG. 7 only in that no reinforced activation zone is provided at support 3 as well as no recess in cover 5. Furthermore, at the level of the straight lateral section 43, mainly in the middle, a particular catch mechanism 51 having a hook is provided to lock the cover at the level of the support in such a way that an autonomous opening of cover 5 is prevented by support 3.

Figure 9:
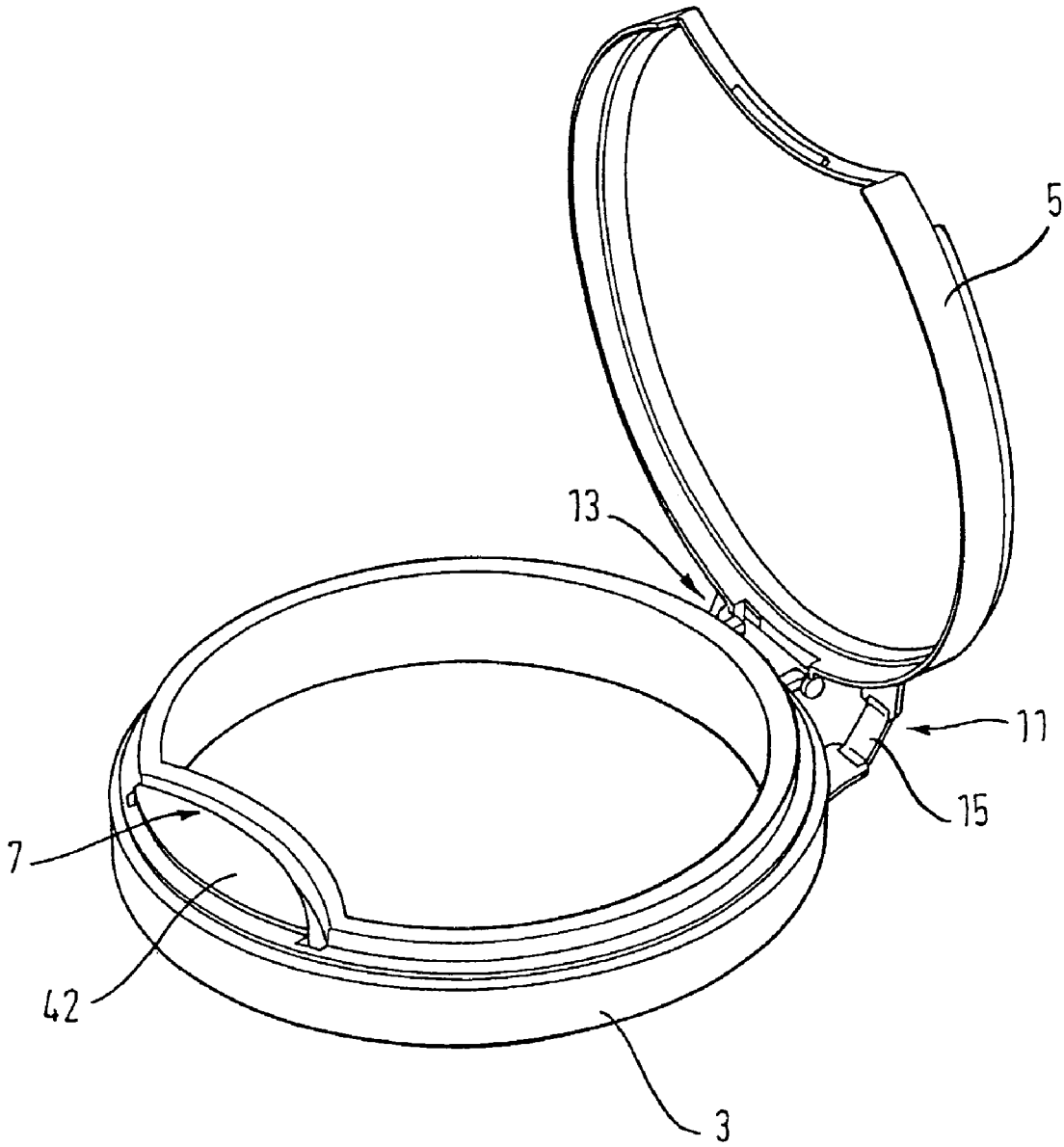
FIG. 9 illustrates another embodiment according to the invention of a cover-support structure.
Figures 10A, 10B, 10C:
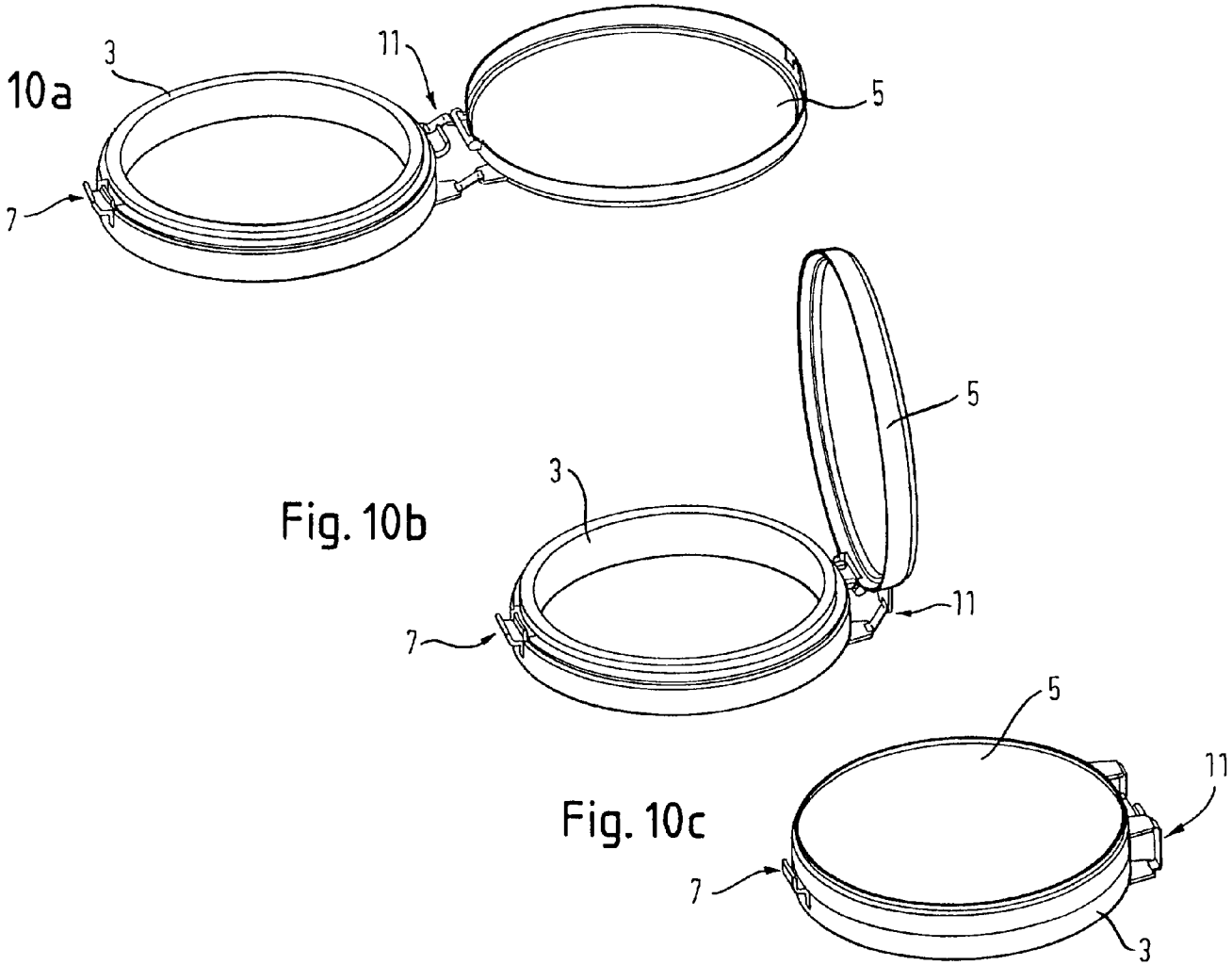
FIGS. 10*a*-10*c* illustrate the cover-support structure according to FIG. 1 respectively in the main working positions—closed, open and waiting, unclamped.
Figures 11A, 11B, 11C:
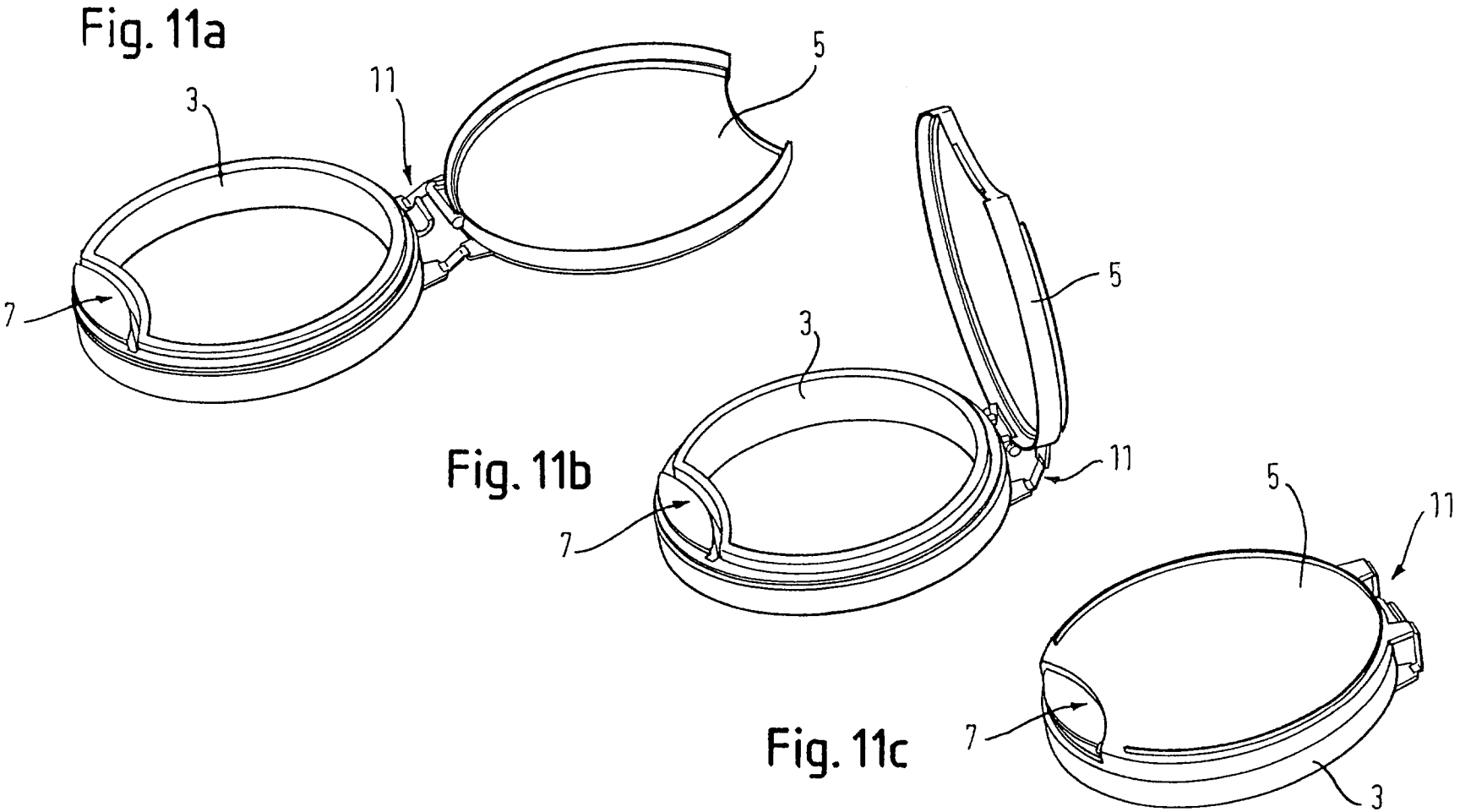
FIGS. 11*a*-11*c* illustrate the cover-support structure according to FIG. 9 respectively in the main working positions of the cover—closed, open and waiting, unclamped.
Figures 12A, 12B, 12C:
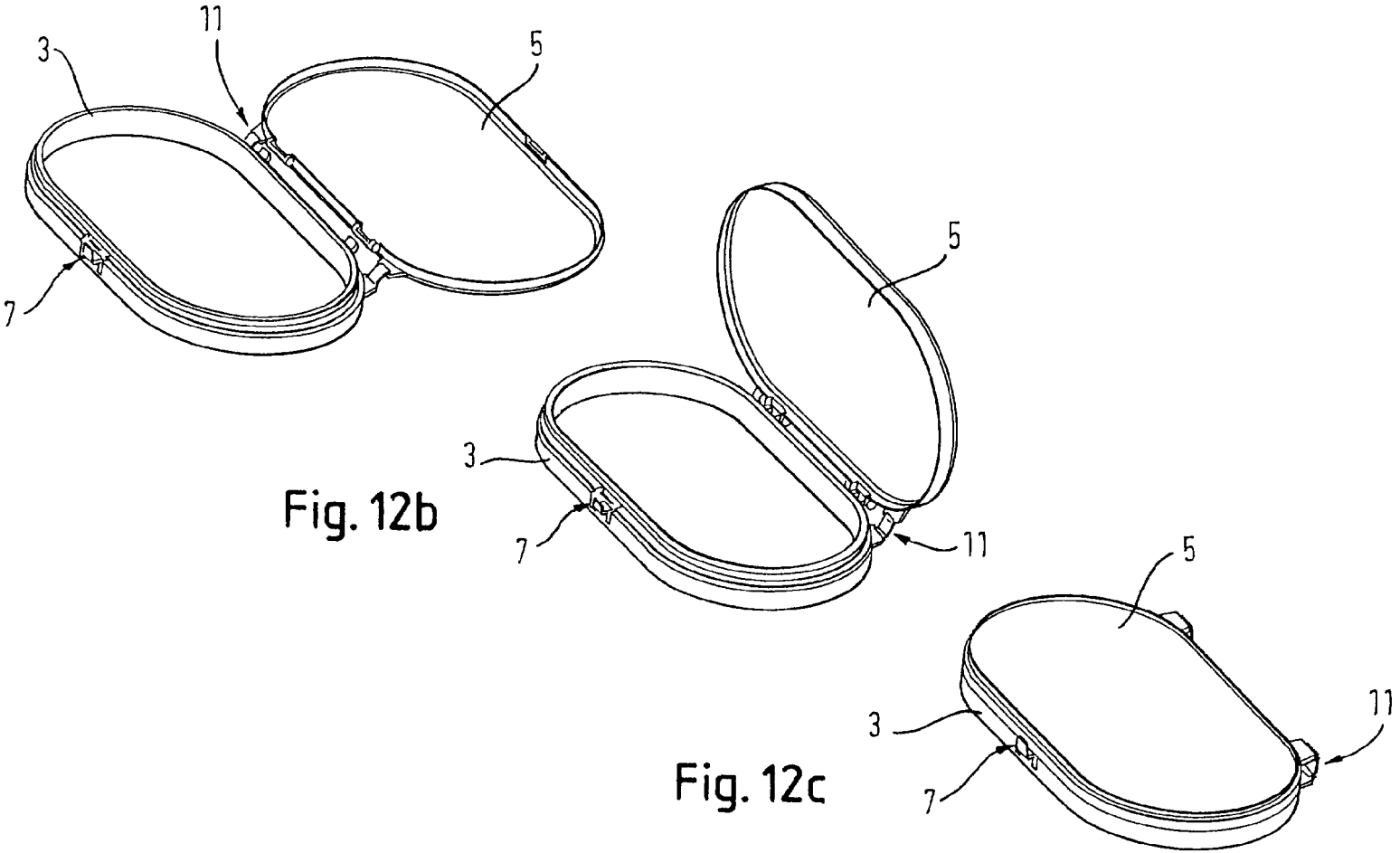
FIGS. 12*a*-12*c* illustrate the cover-support structure according to FIG. 8 respectively in the main working positions—closed, open and waiting, unclamped.
Figures 13A, 13B, 13C:
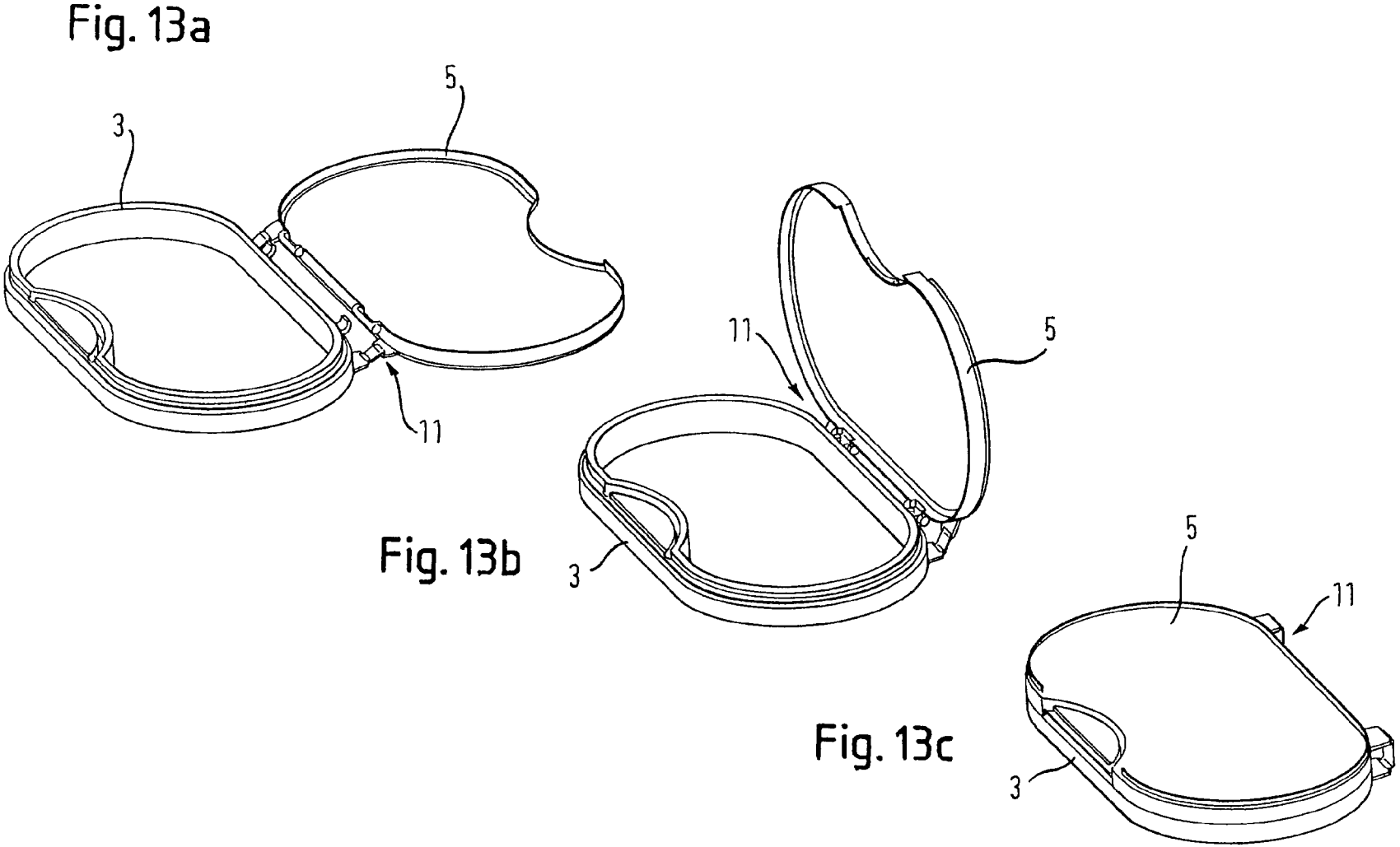
FIGS. 13*a*-13*c* illustrate the cover-support structure according to FIG. 7 respectively in the main working positions—closed, open and waiting, unclamped.

The cover-support structure according to FIG. 9 essentially corresponds to that of FIG. 1, in return a reinforced activation zone 42 disposed at the level of a support section 3 opposite from the articulated structure 11 is provided, which is formed in conformance with the embodiment according to FIG. 7.

In FIGS. 10*a*-10*c* and 11*a*-11*c*, 12*a*-12*c* and 13*a*-13*c*, one may see in which positions cover 5 may be placed on the articulated structure 11 according to the invention. In the figures provided with the letter a, cover 5 is found in an unclamped opening position, in which cover 5 may be placed in a position parallel to the opening section 31 of support 3. In this position, free access to support 3 is made available.

In the figures provided with the letter b, cover 5 is placed in an open vertical waiting position with relation to support 3, from which it may pass without additional assembly steps to the closed position.

In the figures provided with the letter c, the cover 5 is represented in the closed position, in which the elastomer band 15 is prestressed to the maximum and the locking device 7 prevents an autonomous flipping of cover 5. When the locking device 7 is released, the elastomer band 15 pulls the cover 5 into an open waiting position (FIGS. 10*b*, 11*b*, 12*b* and 13*b*).

By releasing the locking device 7 and raising hinge pivot 16 of cylindrical housing 17 from hinge articulation 13 at the same time against the prestressed force F, the unclamped position represented in FIGS. 10*a*, 11*a*, 12*a* and 13*a* may be created.

The existing characteristics given in the description, the figures and claims may also have importance individually or according to a combination chosen to embody the invention in different arrangements.

LIST OF REFERENCES

1 Closing device
3 Support
5 Cover
7 Locking device
11 Articulated structure
12 Sealing lip
13 Hinge
15 Elastomer band
16 Hinge pivot
17 Cylindrical housing
19 Stop surface
20 Stud
21, 23 Projecting parts
25, 27 Force application points
31 Opening section
41, 43 Straight parallel lateral sections
42 Activation zone
51 Catch mechanism
f Prestressed force
s Pivot point
a Leverage

The invention claimed is:

1. An articulated structure to connect a cover (5) to a support (3) that is installed on a container or is formed from a single piece with an opening section of the container, comprising an articulated joint in the form of a hinge (13) to guide the cover (5) between a closed position and an open position with a pivot point (S) situated on at least one of an outer side of the cover (5) and the support (3), and an elastomer spring part connected to the cover (5) as well as the support (3) and is prestressed at least in the closed position of the cover under tension, characterized in that a force application point (25, 27) of the elastomer spring part to the cover (5) and to the support (3) at least in a closed position of the cover (5) is displaced to the outside beyond the pivot point (S) of the hinge (13), wherein said articulated structure includes a first projecting part (21) on the cover (5) and also includes a second projecting part (23) on the support (3), and wherein one said force application point (25) is attached to said projecting part (21) and wherein another said force application point (27) is attached to said projecting part (23), wherein said first projecting part (21) is made of a rigid, non-elastomeric material, wherein said second projecting part (23) is made of a rigid, non-elastomeric material, and wherein said elastomer spring part is an elastomer band comprising an elastomer material that is different than the material of the cover (5) and support (3).

2. The articulated structure according to claim 1, characterized in that the force application point of the elastomer spring part to the cover (5) and to the support (3) at least in the closed position is displaced to the outside, beyond the pivot point (S) with relation to the support.

3. The articulated structure according to claim 1, characterized in that the elastomer spring part is an elastomer band (15).

4. The articulated structure according to claim 1, characterized in that the pivot point (S) is straight.

5. The articulated structure according to claim 1, characterized in that the articulated joint is designed to separate the cover (5) from the support (3).

6. The articulated structure according to claim 1, characterized in that a pivot limitation device is provided, which limits the opening movement of the cover (5).

7. The articulated structure according to claim 6, characterized in that the pivot limitation device is formed of an abutment integrated in the articulated joint.

8. The articulated structure according to claim 6, characterized in that the pivot limitation device limits a pivoting movement of the cover by approximately 90° with relation to the closed position of the cover (5).

9. The articulated structure according to claim 1, wherein said elastomer spring part is more extended when the cover is in the closed position than when the cover is in the open position.

10. The articulated structure of claim 1, wherein said hinge (13) includes a hinge pivot (16) on the cover (5) and also includes a housing (17) on the support (3).

11. The articulated structure of claim 1, wherein said elastomer band comprises a thermoplastic elastomer.

* * * * *